US006016735A

United States Patent [19]

Langner

[11] Patent Number: 6,016,735

[45] Date of Patent: Jan. 25, 2000

[54] WEAPON DISCHARGE CONTAINMENT SYSTEM

[76] Inventor: F. Richard Langner, P.O. Box 14706, Scottsdale, Ariz. 85267

[21] Appl. No.: 09/213,956

[22] Filed: Dec. 17, 1998

[51] Int. Cl.[7] ..... F41H 5/04

[52] U.S. Cl. ..... 89/36.02; 273/403; 273/404; 273/408; 273/410

[58] Field of Search ..... 89/36.02; 273/394, 273/402, 403, 404, 407, 408, 410

[56] References Cited

U.S. PATENT DOCUMENTS

| | | | |
|---|---|---|---|
| 941,642 | 11/1909 | Maxim | 273/410 |

FOREIGN PATENT DOCUMENTS

| | | | |
|---|---|---|---|
| 2465186 | 3/1981 | France | 89/36.02 |
| 3212781 | 10/1983 | Germany | 273/410 |
| 500372 | 3/1939 | United Kingdom | 273/410 |
| 2149482 | 6/1985 | United Kingdom | 89/36.02 |
| 2242730 | 10/1991 | United Kingdom | 273/410 |
| 9427111 | 11/1994 | WIPO | 273/404 |

*Primary Examiner*—Stephen M. Johnson

*Attorney, Agent, or Firm*—LaValle D. Ptak

[57] ABSTRACT

A safety containment system for use during the loading and unloading of firearms, such as handguns, rifles and the like, is made in the form of an elongated hollow steel cylinder. One end of the cylinder is closed with a steel plate; and a rubber-like disk is located between the closed end of the cylinder and the open end to form a bullet containment compartment adjacent the closed end of the cylinder. This compartment is filled with randomly oriented hardened metal objects with sharp edges, such as elongated concrete nails having a substantially rectangular cross section. The other end of the housing has an elongated rubber tube acting as a guide member, secured to the rubber-like disk and to the housing member, for accommodating the muzzle end of a barrel of a firearm inserted therein. Vent holes are located through the housing and through the guide member in the region adjacent the rubber-like disk to permit the release of gases in the event of an accidental discharge of a firearm, the muzzle end of the barrel of which is inserted into the guide member during loading and unloading of the firearm. In the event of an accidental discharge, the bullet passes through the rubber-like disk into the containment compartment, where the sharp edges of the randomly oriented metal objects effect a rapid disintegration of the bullet.

23 Claims, 1 Drawing Sheet

WEAPON DISCHARGE CONTAINMENT SYSTEM

BACKGROUND

Handguns and rifles are in widespread use. Handguns are extensively used both by law enforcement agencies and by people who carry guns for their own protection. Rifles are widely used by hunters and sportsmen. A variety of devices, including safety locks built into handguns and rifles, are used to prevent accidental firing of the guns. Even so, accidental discharges do occur, most frequently during the loading and unloading of the handgun or rifle.

To prevent accidental discharge of handguns and rifles during loading and unloading, devices have been designed to lock the trigger of such guns against inadvertent actuation. Even when such trigger locking devices are provided, however, gun users sometimes forget to employ them; or an inadvertent discharge takes place, even though the trigger is locked against actuation.

Many law enforcement agencies require officers to load and unload guns in a specified location, with the muzzle of the gun pointed toward a barrel of sand or similar material. As a consequence, if an accidental discharge should take place during the loading or unloading of the gun, the bullet which is discharged will strike the sand in the barrel and be stopped within a few inches; so that no harm is done. When firearms are loaded and unloaded in a law enforcement agency location in this manner, the sand barrel theoretically provides the desired level of safety.

A possibility still exists, however, if an officer is distracted or is jostled during the loading and unloading operation, that the barrel of the handgun may not be pointed at the sand barrel. Consequently, in the event of an accidental discharge, the bullet may miss the sand. This is dangerous. Even if the handgun is not pointed directly at a bystander, ricocheting of the bullet or splintering of the bullet can create a potentially harmful situation for both personnel and the surroundings. The situation is even more serious during the loading and unloading of military weapons, which may be loaded with armor piercing bullets. With respect to automatic or semi-automatic weapons, if an accidental discharge should take place during the loading and unloading operation, it is possible that the first discharge of a burst of discharges may create a recoil which kicks the muzzle of the firearm away from being pointed at the sand in the barrel. Another disadvantage of sand barrels of the type which have been used as safety devices in law enforcement agencies is that the barrels and contents are relatively expensive, as well as being heavy and large.

It is desirable to provide a simple and inexpensive containment system capable of working with a wide variety of handguns and rifles, which is relatively small and lightweight, and which absolutely guarantees safety during the loading and unloading of a firearm in the event of an accidental discharge.

SUMMARY OF THE INVENTION

It is an object of this invention to provide an improved safety system for firearms.

It is a further object of this invention to provide an improved firearm discharge safety system.

It is an additional object of this invention to provide an improved firearm discharge containment system for use during the loading and unloading of a firearm.

It is yet another object of this invention to provide an improved, compact firearm discharge safety containment system which is capable of repeated use in the event of accidental discharge of a firearm.

It is a further object of this invention to provide an improved discharge containment safety system for firearms in which the muzzle of a firearm is extended into an opening at one end of the system, and which includes a bullet containment compartment filled with material which stops bullet movement and destroys the bullet in the event of accidental discharge.

In accordance with a preferred embodiment of the invention, a containment system for use during the loading and unloading of firearms, such as handguns and rifles, includes an elongated bullet trap housing with a first closed end and a second open end. A penetrable reclosable seal is located intermediate the first and second ends of the housing to form a bullet containment compartment between the seal and the closed end of the housing. This compartment is filled with randomly oriented hard metal members having sharp edges on them. A guide member is located between the seal and the open end of the housing for accommodating the muzzle end of the barrel of a firearm inserted therein.

DETAILED DESCRIPTION

Figure 1:
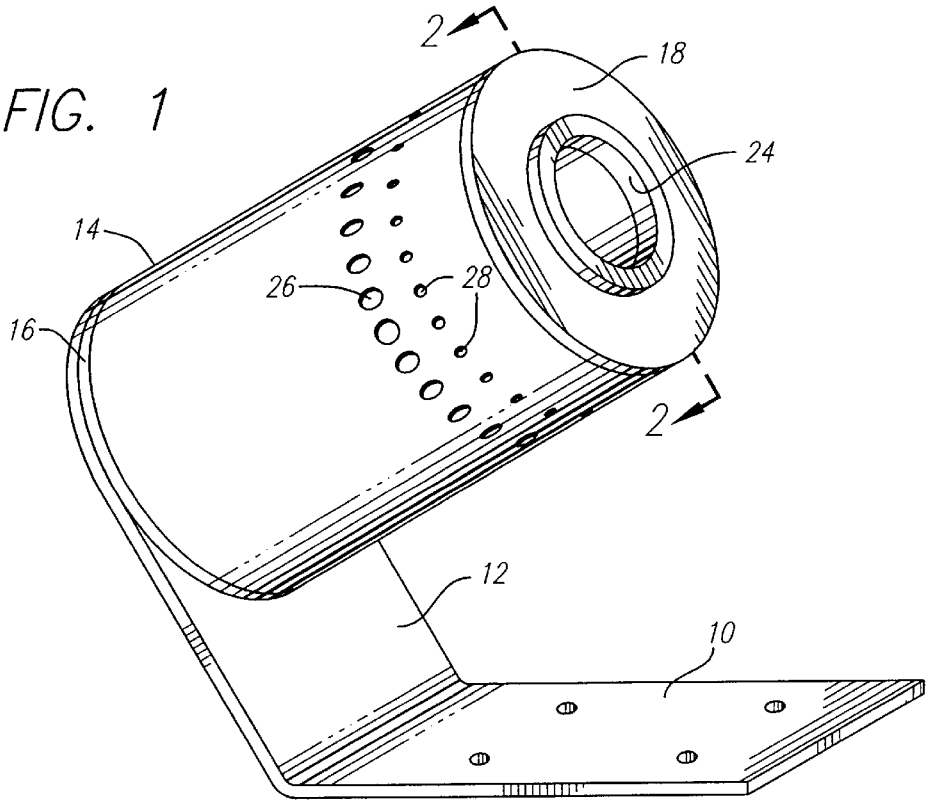
FIG. 1 is a perspective view of a preferred embodiment of the invention.
Figure 2:
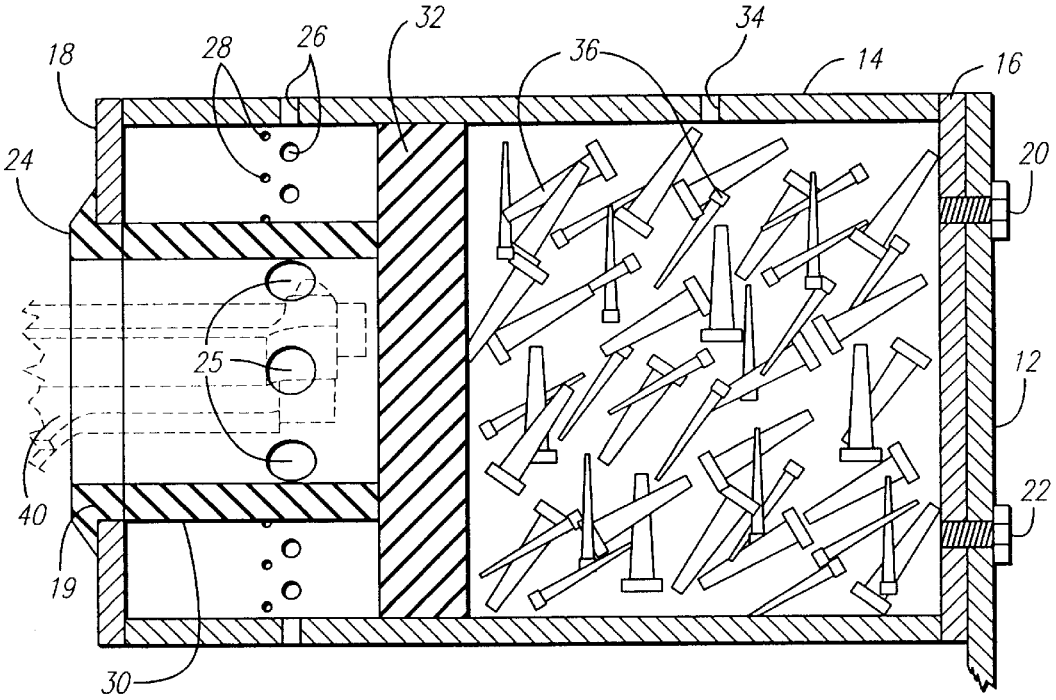
FIG. 2 is a cross-sectional view taken along the line 2—2 of FIG. 1.

Reference now should be made to the drawing, in which the same reference numbers are used in the different figures to designate the same components. FIG. 1 is a perspective view of a weapon discharge safety containment system particularly designed for use with either pistols and rifles. The containment system includes a base 10, which may be attached to any suitable flat surface such as a bench or a desk. The base 10 has an upwardly turned rear support 12, which has a cylindrical bullet containment housing 14 mounted on it. The mounting is illustrated most clearly in FIG. 2. An end plate 16, which is secured to the left-hand end of the housing 14 shown in FIG. 1 (the right-hand end as shown in FIG. 2), is bolted onto the support 12 by means of suitable fastener bolts 20 and 22. The plate 16, is welded or otherwise secured to the cylindrical housing 14 to close the end of the housing; and both of these parts typically are made of steel having a wall thickness of approximately ¼".

The other end of the cylindrical housing 14 is partially closed with a plate 18 attached to the housing. The plate 18 has a circular aperture 19 through it. A rubber lip 24 is inserted into the aperture to provide an opening for the insertion of the muzzle end of the barrel of a firearm 40, indicated in dotted lines in FIG. 2.

Inside the hollow cylindrical housing 14, a hollow cylindrical rubber tube 30, which may be made of a specific rubber compound having a durometer hardness range, Shore A:50–70, is placed. This is shown most clearly in FIG. 2. This internal rubber tube acts as a guide for the muzzle end of a handgun or rifle 40, as illustrated in FIG. 2; so that the muzzle points toward the rear plate 16 of the containment system, again as shown in FIG. 2. The lip 24 and the tube 30 are bonded together or molded in one piece. At the right-hand end of the tube 30, as shown in FIG. 2, a circular rubber-like disk or seal 32 approximately 1" thick is provided. The disk 32 has a medium hardness range to permit penetration of a bullet therethrough with immediate re-closing of the opening. The disk 32 is bonded to the right-hand end (as viewed in FIG. 2) of the cylindrical rubber tube 30.

The space between the rubber disk or seal 32 and the end plate 16 is completely filled with randomly oriented sharp-edged hard metal parts 36. Random orientation of the sharp metal edges ensures that any movement of a bullet into the region occupied by the parts 36 successively encounters the edges on various ones of the parts 36. It has been found that an ideal material for the sharp-edged metal parts 36 is conventional hard steel concrete nails of the type having a rectangular cross section. Other types of hard metal (such as case-hardened steel) objects may be used; but standard concrete nails 36 have been found to be an ideal material to fill the compartment between the disk 32 and the end plate 16.

In the region just to the left-hand side of the disk 32 (as viewed in FIG. 2), a row of vent holes 25 through the tube 30 is provided. In addition, two rows of vent holes 26 and 28 are provided through the housing 14. These vent holes function to facilitate the discharge of any gases which are emitted from the muzzle of a firearm 40 in the event a discharge of the firearm 40 should take place when it is located in the device in the manner illustrated in FIG. 2. Thus, any pressure which is built up by the gases at the point of discharge is rapidly and effectively dissipated through the vent holes 25, 26 and 28.

In the event that a discharge of the firearm 40 should take place when it is located in the position shown in FIG. 2, the bullet exiting the firearm pierces through the rubber-like disk 32, which immediately closes behind the bullet. The bullet then travels into and strikes the randomly oriented sharp-edged metal objects (such as the concrete nails 36) engaging in rapid succession various metal edges, which stop the forward progress of the bullet and at the same time effectively chop the bullet into tiny pieces.

In a typical containment system, the distance between the rubber disk 32 and the end plate 16 is approximately 5", with the overall length of the containment housing cylinder 14 being 9" with a 5½" diameter. In the event that any additional gas pressure buildup should also take place upon the entry of a bullet into the nail filled bullet containment compartment, a small vent 34 is provided into the compartment to facilitate the exit of any gas pressure which may build up in this region of the containment system. It should be noted, however, that the vent holes 26 and 28 typically remove all of the gas pressure from a firearm discharge and that the vent hole 34 generally relieves little or no pressure. The vent hole 34, however, is provided to ensure that there is no undue pressure buildup in the bullet trap compartment filled with the sharp-edged hard metal objects 36.

An advantage of the containment system which is illustrated and which has been described above is that in addition to its relatively small size and ease of mounting in a variety of locations, the device may be used repeatedly after a weapon discharge takes place. As mentioned above, the rubber-like disk 32 closes behind a bullet passing through it; so that even though it has been penetrated, it may be penetrated again in a subsequent discharge. The random packing of the concrete nails 36, or other sharp-edged hard metal objects, in the trap compartment formed between the end plate 16 and the rubber disk 32 operates such that once a bullet passes into this compartment, the various parts 36 are moved and re-oriented. Thus, a subsequent bullet entering the compartment encounters additional sharp edges of the objects 36 located in it and is stopped and disintegrated by the presentation of new cutting edges as the bullet enters the containment compartment.

In actual tests of prototypes of the containment system which is illustrated in FIGS. 1 and 2, the use of standard commercial hardened concrete nails for the objects 36 in the compartment for trapping bullets has been found to stop and disintegrate even armor piercing bullets, including multiple successive discharges from an automatic weapon. The bullets do not even reach the end of the plate 16. If they did, however, the end plate 16 coupled to the support flange 12 is thick enough to stop whatever bullet residue might remain and travel this far.

Since the containment system which is illustrated in FIGS. 1 and 2 requires the user to insert the muzzle end of the barrel of a firearm into the opening in the sleeve 24, the end of the barrel is guided by the rubber sleeve 30 to a position generally as shown in dotted lines in FIG. 2. Thus, the open end of the barrel of the firearm is pointed directly at the nail-filled compartment on the opposite side of the disk 32; so that if an accidental discharge does take place, the bullet necessarily passes through the disk 32 into the randomly packed sharp-edged parts (concrete nails), where it is stopped and pulverized by the sharp edges on the metal objects 36 filling the bullet trap compartment. Accidental discharges are highly unlikely and do not occur very frequently. When they do occur, however, the containment system which is illustrated in the drawings and which has been described above effectively and safely prevents any harm from taking place, since the bullet is stopped and disintegrates a short distance from its entry point into the nail filled bullet trap compartment.

The foregoing description of the preferred embodiment of the invention is to be considered as illustrative, and not as limiting. Various changes will occur to those skilled in the art for performing substantially the same function, in substantially the same way, to achieve substantially the same result without departing from the true scope of the invention as defined in the appended claims.

What is claimed is:

1. A containment system for use during the loading and unloading of firearms including in combination:

a bullet trap housing having a first predetermined length with a first closed end and a second open end;

a penetrable reclosable seal located between the first and second ends of said bullet trap housing forming a bullet containment compartment between said seal and the closed end of said housing; and randomly oriented, movably packed hard metal members with sharp edges thereon filling said bullet containment compartment.

2. The combination according to claim 1 wherein said bullet trap housing is a metal housing.

3. The combination according to claim 2 wherein said bullet trap housing is made of steel.

4. The combination according to claim 3 wherein said bullet trap housing is a cylindrical housing.

5. The combination according to claim 1 wherein said bullet trap housing is a cylindrical housing.

6. The combination according to claim 5 wherein said bullet trap housing is made of steel.

7. The combination according to claim 1 wherein said bullet trap housing is made of steel.

8. The combination according to claim 7 wherein said hard metal members comprise hardened steel concrete nails having a substantially rectangular cross section.

9. The combination according to claim 1 wherein said housing comprises a steel cylinder approximately 9 inches long by 5½ inches in diameter, with a wall thickness of approximately ¼ inch and wherein said closed end comprises a steel plate approximately ½ inch thick, and said seal comprises a rubber disk approximately 1 inch thick.

10. The combination according to claim 9 wherein said hard metal members comprise hardened steel concrete nails having a substantially rectangular cross section.

11. A containment system for use during the loading and unloading of firearms including in combination:

a bullet trap housing having a first predetermined length with a first closed end and a second open end;

a penetrable reclosable seal located between the first and second ends of said bullet trap housing forming a bullet containment compartment between said seal and the closed end of said housing; and randomly oriented hardened steel concrete nails having a substantially rectangular cross section filling said bullet containment compartment.

12. The combination according to claim 11 further including a guide member between said seal and the open end of said housing for accommodating the muzzle end of the barrel of a firearm inserted therein.

13. The combination according to claim 12 wherein said guide member comprises a hollow rubber tube bonded to said seal.

14. The combination according to claim 13 wherein said guide member has an internal diameter which is less than the internal diameter of said bullet trap housing.

15. The combination according to claim 14 further including vent holes through said housing and through said guide member between the open end of said housing and said seal for venting gases out of said bullet trap housing in the event of a discharge of a firearm, the barrel of which is inserted into said guide member.

16. The combination according to claim 15 further including a mounting bracket secured to the closed end of said housing.

17. The combination according to claim 16 wherein said housing comprises a steel cylinder approximately 9 inches long by 5½ inches in diameter, with a wall thickness of approximately ¼ inch and wherein said closed end comprises a steel plate approximately ½ inch thick, and said seal comprises a rubber disk approximately 1 inch thick.

18. The combination according to claim 12 wherein said guide member has an internal diameter which is less than the internal diameter of said bullet trap housing.

19. The combination according to claim 18 further including vent holes through said housing and through said guide member between the open end of said housing and said seal for venting gases out of said bullet trap housing in the event of a discharge of a firearm, the barrel of which is inserted into said guide member.

20. The combination according to claim 19 wherein said guide member comprises a hollow rubber tube bonded to said seal.

21. A containment system for use during the loading and unloading of firearms including in combination:

a bullet trap housing having a first predetermined length with a first closed end and a second open end;

a penetrable reclosable seal located between the first and second ends of said bullet trap housing forming a bullet containment compartment between said seal and the closed end of said housing;

a guide member in the form of a hollow rubber tube between said seal and the open end of said housing for accommodating the muzzle end of the barrel of a firearm inserted therein, said guide member bonded to said seal; and randomly oriented hard metal members with sharp edges thereon filling said bullet containment compartment.

22. The combination according to claim 21 wherein said guide member has an internal diameter which is less than the internal diameter of said bullet trap housing.

23. The combination according to claim 22 wherein said housing comprises a steel cylinder approximately 9 inches long by 5½ inches in diameter, with a wall thickness of approximately ¼ inch and wherein said closed end comprises a steel plate approximately ½ inch thick, and said seal comprises a rubber disk approximately 1 inch thick.

* * * * *